United States Patent [19]

Matsumoto et al.

[11] Patent Number: 4,962,079

[45] Date of Patent: Oct. 9, 1990

[54] OVERCOATED HEAT-SENSITIVE RECORD MATERIALS

[75] Inventors: Hisashi Matsumoto, Kobe; Masaaki Takami, deceased, late of Kakogawa, by Harumi Takami, legal representative; Nobuyuki Takahashi, Sakai; Tetsuya Inoue, Osaka, all of Japan

[73] Assignees: Mitsubishi Paper Mills Limited, Tokyo; Arakawa Chemical Industries, Ltd., Osaka, both of Japan

[21] Appl. No.: 286,048

[22] Filed: Dec. 19, 1988

[30] Foreign Application Priority Data

Dec. 25, 1987 [JP] Japan ..... 62-330611

[51] Int. Cl.[5] ..... B41M 5/18

[52] U.S. Cl. ..... 503/226; 427/152; 503/200

[58] Field of Search ..... 427/150–152; 503/200, 226

[56] References Cited

FOREIGN PATENT DOCUMENTS

| | | | |
|---|---|---|---|
| 15191 | 1/1985 | Japan | 503/226 |
| 1011288 | 1/1986 | Japan | 503/226 |
| 2171810 | 9/1986 | United Kingdom | 503/226 |

*Primary Examiner*—Pamela R. Schwartz

*Attorney, Agent, or Firm*—Larson and Taylor

[57] ABSTRACT

This invention provides an overcoat composition for a heat-sensitive record material comprising as an effective component thereof an emulsion of graft copolymer prepared by graft-copolymerizing methyl (meth)acrylate (A), a lower hydroxalkyl (meth)acrylate (B) and (meth)acrylic acid (C) with a polyvinyl alcohol in the presence of water and a neutralization salt of diisobutylene-maleic anhydride copolymer; a heat-sensitive record material having a heat-sensitive layer coated over its surface with an overcoat composition defined above; and a process for preparing a heat-sensitive record material comprising coating the surface of the heat-sensitive layer of a heat-sensitive record material with an overcoat composition defined above.

7 Claims, No Drawings

OVERCOATED HEAT-SENSITIVE RECORD MATERIALS

The present invention relates to overcoat compositions capable of giving heat-sensitive record materials, especially heat-sensitive record paper, high resistance to water, plasticizers and chemicals, anti-sticking property and color forming property.

Heat-sensitive record materials are in wide use which comprise a colorless or pale-colored leuco dye and a color developer for causing the dye to form a color when hot. Usual heat-sensitive record materials are prepared by communiting a leuco dye and a color developer, such as a phenolic substance, separately into minute particles of up to several micrometers in size by a wet mill to obtain dye and developer dispersions, mixing the dispersions together, adding a binder, sensitizer, filler, lubricant, stabilizer, dispersant, defoaming agent and like auxiliary agents to the mixture to obtain a coating composition, and applying the composition to a substrate such as paper, film, synthetic paper or the like. When the heat-sensitive record material is heated, at least one of the leuco dye and the color developer melts, whereupon the two components come into contact with each other to undergo a chemical reaction and produce a color record. Heat-sensitive record materials of this type have the advantage of being amenable to printing to produce distinct records and are therefore widely used, for example, for facsimile systems and printers.

With use of diversified data media in recent years, such record materials have found other use, for example, as paper for automatic ticket vending machines for commutation tickets, bar code paper for POS systems and labels for commodities. When used for these new applications, the record material is generally subjected to severer conditions than in conventional applications. For example, when the commutation ticket is held in contact with a ticket holder made of polyvinyl chloride containing tibutyl phthalate or like plasticizer, the record is likely to fade away or the unrecorded area will develop a color to impair the value of the record material. The material must therefore have resistance to plasticizers. Further for use as labels on food products, the record material needs to have resistance to water, alcohol, oil, vinegar, etc. in addition to resistance to plasticizers.

In order to fulfill these requirements, attempts have been made to apply a water-soluble resin, water-insoluble resin emulsion or like overcoat agent (such as modified polyvinyl alcohol or styrene-butadiene latex) to the heat-sensitive color forming layer on the substrate and thereby prevent water, chemicals, etc. from penetrating into the layer. However, this method, although satisfying the above requirements to some extent, invariably results in a lower color forming property and is unable to assure the desired antisticking property and satisfactory resistance to water, plasticizers and chemicals at the same time.

An object of the present invention is to provide an overcoat composition capable of giving a heat-sensitive record material the desired high resistance to water, plasticizers, chemicals and sticking without impairing the color forming ability of the material.

Another object of the invention is to provide a heat-sensitive record material having an excellent color forming property and high resistance to water, plasticizers, chemicals and sticking as desired.

These and other objects of the invention will become apparent from the following description.

The present invention provides a overcoat composition for a heat-sensitive record material comprising as an effective component thereof an emulsion of graft copolymer prepared by graft-copolymerizing (A) methyl (meth)acrylate (hereinafter referred to as the "monomer A"), (B) a lower hydroxyalkyl (meth)acrylate (hereinafter referred to as the "monomer B") and (C) (meth)acrylic acid (hereinafter referred to as the "monomer C") with a polyvinyl alcohol in the presence of water and a neutralization salt of diisobutylene-maleic anhydride copolymer.

In the course of our research, we prepared a graft copolymer emulsion by graft-copolymerizing the monomers A, B and C with a polyvinyl alcohol as dissolved in water, in the presence of a neutralization salt of diisobutylene-maleic anhydride copolymer serving as a dispersant. Our research have revealed that the emulsion, when applied to a heat-sensitive record material as a topcoat composition, gives the material high resistance to water, plasticizers, chemicals and sticking as desired without substantially impairing the color forming property of the material.

The polyvinyl alcohol to be used in the invention is not limited specifically insofar as it is soluble in water but can be any of those heretofore known. Preferably, however, it is a partially or completely saponified product having a polymerization degree of 200 to 2500 and a saponification degree of 75 to 100%. Since the polyvinyl alcohol influences the film forming property of the topcoat composition to be obtained and the resistance thereof to water, chemicals and plasticizers, the amount of the alcohol to be used is suitably determined in view of these properties and is generally preferably 5 to 100 parts by weight (hereinafter part by weight being expressed merely as part) per 100 parts of the combined amount of the monomers to be stated below. If the amount is less than 5 parts, the overcoat composition tends to be lower in film forming property and chemical resistance, and the heat-sensitive color forming layer will exhibit an impaired color forming property, whereas when the amount exceed 100 parts, the overcoat composition is likely to exhibit lower water resistance and an increased viscosity. More preferably, the amount is 20 to 70 parts.

The graft chain monomers to be subjected to graft copolymerization according to the invention are the monomers A, B and C.

The monomer A, methyl acrylate and/or methacrylate, is an essential component since it is effective for giving enhanced water resistance to the overcoat composition to be obtained. Preferably, the monomer A is used in an amount of 15 to 85 wt. % based on the entire combined amount (100 wt. %) of the monomers to be used in the invention. When the amount is less than 15 wt. %, lower resistance to water and to sticking tends to result, whereas if the amount is over 85 wt. %, an impaired film forming property will result to entail lower resistance to chemicals. More preferably, the amount is 25 to 60 wt. %.

The monomer B, a lower hydroxyalkyl acrylate and/or methacrylate, is effective for giving increased resistance to chemicals and plasticizers to the overcoat composition and is therefore another essential component. Examples of useful monomers B include 2-hydroxyethyl (meth)acrylate and 2-hydroxypropyl (meth)acrylate. The amount of the monomer B is determined suitably in view of the resistance to chemicals and plasticizers of the overcoat composition to be obtained and is preferably 15 to 75 wt. % of the entire combined amount (100 wt. %) of the monomers to be used in the invention. When the amount is less than 15 wt. %, the composition tends to exhibit insufficient resistance to chemicals and plasticizers, whereas if it is over 75 wt. %, the polymerization reaction is likely to involve gelation or give a product of increased viscosity. More preferably, the amount is 20 to 45 wt. %.

The monomer C, acrylic and/or methacrylic acid, is an important component since the monomer exerts an influence on the chemical resistance and color density of the overcoat composition to be obtained and on the stability of the emulsion during graft polymerization. The amount of the monomer C to be used, which is determined suitably in view of these properties, is usually preferably 5 to 45 wt. % based on the combined amount, calculated as 100 wt. %, of the monomers to be used in the invention. If the amount is less than 5 wt. %, the emulsion obtained tends to be unstable, whereas amounts over 45 wt. % tend to result in lower water resistance and impair the stability of the emulsion. More preferably, the amount is 10 to 30 wt. %.

In addition to the monomers A, B and C, other vinyl monomer D copolymerizable with these monomers is usable in the present invention as another graft copolymer component when so required. Examples of such monomers are ethyl (meth)acrylate, butyl (meth)acrylate, propyl (meth)acrylate, 2-ethylhexyl (meth)acrylate, octyl (meth)acrylate, (meth)acrylonitrile, vinyl acetate, styrene, (meth)acrylamide and like vinyl monomers. The monomer D can be used in a suitably determined amount within such a range that the resulting overcoat composition fulfills the objects of the invention and assures the advantages of the invention. Usually it is desired that the amount be up to 30 wt. % of the combined amount (100 wt. %) of the monomers used in the invention.

According to the present invention, it is essential to use a neutralization salt of diisobutylene-maleic anhydride copolymer as a dispersant for the following reason. If the monomers A, B, C and, when required, the monomer D are graft-polymerized with polyvinyl alcohol in the presence of a known usual anionic or nonionic surfactant, the overcoat composition obtained is extremely low in resistance to water and to sticking, failing to achieve the objects of the invention in any way, whereas it is only in the presence of the neutralization salt of diisobutylene-maleic anhydride copolymer that the monomers A, B and C (and D) can be subjected to polymerization reaction while being dispersed in the form of fine oily droplets to give a graft copolymer emulsion with good stability.

The neutralization salt of diisobutylene-maleic anhydride copolymer can be prepared easily by the following method although this method is not limitative. The desired product is prepared by subjecting approximately equimolar amounts of diisobutylene and maleic anhydride to solution polymerization in a reactor in the presence of a radical polymerization initiator, such as a peroxide or azo compound, to obtain a copolymer, and neutralizing the copolymer with at least one of an alkali metal hydroxide such as sodium hydroxide, ammonia and an organic amine such as monoethanolamine. An alkaline earth metal hydroxide such as calcium hydroxide is usable in combination with the above neutralizing agent. Although not limited specifically, the degree of neutralization is usually about 80 to about 120% in view of the ability of the salt to disperse the monomers. The diisobutylene-maleic anhydride copolymer is not limited specifically in the copolymerization ratio of the structural units, average molecular weight, etc. Preferably, however, the copolymer is 2000 to 200000 in weight average molecular weight. Further preferably, the copolymer salt is used usually in an amount (calculated as solids) of 2.5 to 40 parts per 100 parts of the combined amount of the monomers used. If the amount is less than 2.5 parts, it is difficult to obtain a stable emulsion, while when it is over 40 parts, insufficient chemical resistance tends to result. More preferably, the amount is 5 to 20 parts.

The process for preparing the graft copolymer emulsion which is useful as the effective component of the present composition is not limited specifically but can be any of various processes. The emulsion can be prepared easily, for example, by placing specified amounts of polyvinyl alcohol, the dispersant, i.e. the neutralization salt of diisobutylene-maleic anhydride copolymer, and water into a reactor, stirring the mixture to obtain an aqueous solution, and adding the monomers A, B and C and, when required, the monomer D, and the radical polymerization initiator to the solution to react the components at the same time, or continuously adding these compounds dropwise or in divided portions to the solution. The reaction is carried out at 60° to 90° C. for about 1 to about 4 hours. Although the monomer concentration of the polymerization system in the above process or in any other process is not limited specifically, it is usually preferably 10 to 50 wt. %, more preferably 15 to 40 wt. %. The radical polymerization initiator is not limited specifically either but can be any of those known and soluble in water, such as hydrogen peroxide, ammonium persulfate or potassium persulfate, as suitably selected. The initiator is used usually in an amount of 0.1 to 5 parts per 100 parts of the combined amount of the monomers used. A reducing agent is usable conjointly with the radical polymerization initiator to make the reaction system a redox system. To adjust the degree of polymerization and thereby obtain a product of desired viscosity, a chain transfer agent such as a mercaptan is also usable.

The graft copolymer emulsion thus obtained and serving as the effective component of the present overcoat composition is usable as it is for various heat-sensitive record materials such as ticket paper for automatic ticket vending machines and bar code paper for POS systems already mentioned to exhibit outstanding resistance to water, chemicals, plasticizers and sticking without impairing the color forming property of the heat-sensitive color forming layer. According to the invention, the graft copolymer emulsion can be used in combination with a known water-resistant agent such as polyamidopolyamine resin as modified with epichlorohydrin or aminoformaldehyde resin to give further improved water resistance when so desired. The emulsion can also be used conjointly with higher fatty acid, higher fatty acid amide, metal salt of higher fatty acid such as zinc stearate, aluminum stearate or calcium stearate, or the like, whereby further improved resistance to sticking can be obtained. It is preferable to use the water-resistant agent usually in an amount of about 5 to about 30 parts per 100 parts of the emulsion, calculated as solids. The metal salt of higher fatty acid or like agent for giving improved antisticking property is used usually preferably in an amount of about 5 to about 20 parts per 100 parts of the emulsion, calculated as solids.

The present overcoat composition is not limited specifically in concentration and viscosity when to be applied to heat-sensitive record materials. Usually it is desirable that the composition be 10 to 30 wt. % in concentration, 50 to 500 cps in viscosity (at 25° C.) and 4.5 to 9.5 in pH. Although the method of coating is not limited specifically, wire bar, blade coater, air knife coater, roll coater or the like is usually usable. The amount of composition to be applied can be suitably determined in view of the type of heat-sensitive record material and is usually adjusted preferably to 0.5 to 15 $g/m^2$ calculated as solids.

The coating is dried by known means such as oven or drum dryer.

Known heat-sensitive record materials can be coated as they are with the present overcoat composition. Such record materials comprise a heat-sensitive color forming layer of leuco dye and color developer which is bonded to a substrate with a binder and are useful as ticket paper for automatic ticket machines, bar code paper for POS systems, labels on commodities, etc. as already stated.

Examples of useful binders are water-soluble high-molecular-weight compounds such as polyvinyl alcohol, carboxymethyl cellulose, hydroxyethyl cellulose, methoxy cellulose, carboxyl-modified polyvinyl alcohol, polyacrylamide, polyacrylic acid, starch and derivatives thereof, casein, gelatin, alkali salt of styrene-maleic anydride copolymer and the like, and water-insoluble resins such as styrene-butadiene latex and the like.

The leuco dye can be any of various known compounds including lactone compounds having a lactane ring in the molecule and non-lactone compounds having no lactone ring. Especially desirable are lactone compounds of the triphenylmethane or like triarylmethane type, and lactone compounds of the fluoran type.

Examples of useful fluoran compounds are 2-anilino-3-methyl-6-diethylaminofluoran, 2-anilino-3-methyl-6-(methylcyclohexlamino)fluoran, 2-anilino-3-methyl-6-(ethylisobenzylamino)fluoran, 2-(p chloroanilino)-3-methyl-6-diethylaminofluoran, 2-(p-fluoroanilino)-3-methyl-6-diethylaminofluoran, 2-anilino-3-methyl-6-(p-toluidinoethylamino)fluoran, 2-(p-toluidino)-3-methyl-6-diethylaminofluoran, 2-(o-chloroanilino)-6-dibutylaminofluoran, 2-(o-fluoroanilino)-6-diethylaminofluoran, 2-(o-fluoroanilino)-6-dibuthylaminofluoran, 2-anilino-3-methyl-6-piperidinofluoran, 2-anilino-3-methyl-6-pyrrolidinofluoran, 2-ethoxyethylamino-3-chloro-6diethylaminofluoran, 2-anilino-3-chloro-6-diethylaminofluoran, 2-chloro-6-diethylaminofluoran, 2-methyl-6diethylaminofluoran and the like. Examples of useful triarylmethane compounds are 3,3,-bis(p-dimethylaminophenol)-6-dimethylaminophthalide (i.e., Crystal Violet lactone), 3,3 bis(p-dimethylaminophenol)phthalide, 3 (p-dimethylaminophenol)-3-(1,2-dimethylaminoindole 3-yl)-phthalide and the like. These leuco dyes are used singly or in admixture.

Examples of useful color developers are phenolic substances including p-octylphenol, p-tert-buthylphenol, 1,1-bis(p-hydroxyphenyl)propane, 2,2-bis(p-hydroxyphenyl)propane, 1,1-bis(p-hydroxyphenyl)cyclohexane, 4,4-thiobisphenol, 4,4-sulfonyldiphenol, bis(3 allyl 4-hydroxphenyl)sulfone, novolak phenol resin, p-hydroxybenzoic acid ester, dimethyl 4-hydroxyphthalate, dimethyl 5-hydroxyisophthalate, 3,5-di-tert-butylsalicylic acid, 3,5-di-α-methylbenzylsalicylic acid and the like. Polyvalent metal salts of aromatic carboxylic acids are also usable.

Examples of useful fillers are finely divided inorganic compounds such as finely divided calcium carbonate, magnesium carbonate, titanium oxide, zinc oxide, silica, aluminum hydroxide, zinc hydroxide, barium sulfate, clay, talc, and calcium or silica as surface-treated, and finely divided organic compounds such as finely divided urea-formalin resin and polystyrene resin.

Examples of additives which are used when required are zinc stearate, calcium stearate, stearic acid amide and like lubricants, various surfactants, defoaming agents, dispersants, stabilizers, sensitizers and like auxiliary agents.

Examples of useful substrates for forming the heat-sensitive color forming layer are paper, synthetic paper, film, etc.

The present invention will be described in greater detail with reference to the following reference example, examples and comparative examples. However, the invention is not limited only to these examples.

REFERENCE EXAMPLE 1

Preparation of heat-sensitive color forming layer

| | |
|---|---|
| 2-Anilino-3-methyl-6-diethylaminofluorane | 10 parts |
| 10% Aqueous solution of hydroxyethyl cellulose | 5 parts |
| Water | 15 parts |
| Bis(3-allyl-4-hydroxyphenyl)sulfone | 25 parts |
| 1,1,3-Tris(3-tert-butyl-4-hydroxy-6-methylphenyl)butane | 10 parts |
| 10% Aqueous solution of polyvinyl alcohol | 20 parts |
| Water | 45 parts |
| Zinc stearate | 10 parts |
| Calcium carbonate | 40 parts |
| 5% Aqueous solution of methyl cellulose | 50 parts |
| Water | 50 parts |

The mixture (a), (b) and (c) of the above compositions were treated in a sand mill to pulverize the solids therein to particles of up to 2 μm in mean size and obtain dispersions (a), (b) and (c). Subsequently, 6 parts of the dispersion (a), 20 parts of the dispersion (b), 30 parts of the dispersion (c), 70 parts of 10% polyvinyl alcohol aqueous solution and 25 parts of 20% stearic acid amide emulsion (brand name: "Hydrin M-7", product of Chuko Yushi Co., Ltd., Japan) were mixed together with stirring to obtain a heat-sensitive coating composition, which was then applied in an amount of 6 $g/m^2$ (when dried) to commercial wood-free paper weighing 60 $g/m^2$ using a wire bar. The coating was dried to obtain a heat-sensitive record material having a heat-sensitive color forming layer.

EXAMPLE 1

Into a reactor having a stirrer and a reflux condenser were placed 40 parts of completely saponified polyvinyl alcohol (hereinafter referred to as "PVA 110") having a polymerization degree of 1100 and 560 parts of water, and the mixture was stirred with heating to obtain an aqueous solution. To the solution were added 40 parts of methyl methacrylate, 35 parts of 2-hydroxyethyl acrylate and 25 parts of methacylic acid. Further with addition of 40 parts of 25 wt. % aqueous solution of ammonium salt of diisobutylene-maleic anhydride copolymer having a neutralization degree of 100%, the mixture was stirred at room temperature for 30 minutes to obtain an emulsion. Further with addition of 1.0 parts of ammonium persulfate serving as a polymerization initiator, the emulsion was heated to 80° C. and maintained at this temperature for 2 hours, giving a graft copolymer emulsion on completion of the reaction. The emulsion obtained contained 20 wt. % of solids based on the whole amount thereof and had a pH of 6.0 and viscosity of 300 cps at 25° C.

The emulsion only was applied as an overcoat composition to the heat-sensitive color forming layer formed in Reference Example 1 in an amount of 3.0 to 4.0 g/m$^2$ calculated as solids when dried, and the coating was dried to obtain a heat-sensitive record paper having its heat-sensitive color forming layer covered with the overcoat composition.

Characters were printed on the record paper using a label printer (product of Ishida Hakari Co., Ltd., Japan), and the paper was then tested for color forming property and resistance to water, plasticizer, oil, alcohol, vinegar and sticking by the following methods. Table 2 shows the results. The ingredients and properties of the overcoat composition ar listed in Table 1.

Color forming property

The color density (dynamic) of the printed area of the print was measured by Macbeth densitometer RD-514 (No. 106). The density of the background area was also measured by the same method as above. Water resistance The print was immersed in water at 20° C. for 24 hours and then checked for fading and strength of the layer.

Evaluation of test result

A: Good
B: Fair
C: Poor

Plasticizer resistance

The print was held in contact with a commercial sheet of soft polyvinyl chloride (brand name: "Diawrap MS-A") under a load of 300 g/cm$^2$ at 40° C. and 65% RH for 72 hours and then checked for fading of the image and fogging.

Evaluation of test result

A: Good
B: Slightly poor
C: Poor

Oil resistance

Commercial salad oil was applied to the print, which was then allowed to stand at 40° C. for 24 hours and then checked for fading and coloration of the background.

Evaluation of test result

A: Good
B: Slightly poor
C: Poor

Alcohol resistance

The print was immersed in commercial sake (special grade) at 20° C. for 24 hours. The color density of the printed area and the background area was then measured using the Macbeth densitometer RD-514. Vinegar resistance The print was immersed in commercial vinegar (cereal vinegar) at 20° C. for 24 hours. The color density of the printed area and the background area was then measured using the Macbeth densitometer RD-514.

Sticking resistance

The record paper was checked for this resistance according to the sticking noise produced when the paper was printed on by the label printer.

Evaluation of test result

◎: No sticking noise
○: Almost no sticking noise
X: Considerable sticking noise

EXAMPLE 2

A heat-sensitive record paper was prepared in the same manner as in Example 1 with the exception of using a partially saponified polyvinyl alcohol (hereinafter referred to as "PVA 210") having a polymerization degree of 1100 and a saponification degree of 88% in place of PVA 110. The paper was tested for properties by the same methods as in Example 1. Table 1 shows the ingredients and properties of the overcoat composition obtained. Table 2 shows the test results achieved by the paper.

EXAMPLE 3

A heat-sensitive record paper was prepared in the same manner as in Example 1 except that PVA 110 was used in an amount of 20 parts. The paper was tested for properties by the same methods as in Example 1. Table 1 shows the ingredients and properties of the overcoat composition obtained. Table 2 shows the test results achieved by the paper.

EXAMPLES 4 to 9

Heat-sensitive record papers were prepared in the same manner as in Example 1 with the exception of using the monomers A, B and C in the amounts listed in Table 1 and using acrylonitrile as the monomer D in the listed amount in Example 9. The papers were tested for properties by the same methods as in Example 1. Table 1 shows the ingredients and properties of each overcoat composition obtained. Table 2 shows the test results achieved by the papers.

EXAMPLE 10

To 100 parts of the emulsion obtained in Example 1 was added 4.4 parts of zinc stearate emulsion having a concentration of 45 wt. %, and the mixture was uniformly stirred to obtain an overcoat composition, which contained 20 wt. % of solids and had a pH of 6 and a viscosity of 250 cps at 25° C.

An overcoat layer chiefly comprising the composition was formed over the heat-sensitive color forming layer prepared in Reference Example 1 in the same manner as in Example 1 to obtain a heat-sensitive record paper. The paper was used for printing and tested in the same manner as in Example 1. Table 2 shows the results. Table 1 shows the ingredients and properties of the overcoat composition obtained.

EXAMPLE 11

To 100 parts of the emulsion obtained in Example 1 were added 4.4 parts of zinc stearate emulsion having a concentration of 45 wt. % and 20 parts of 10 wt. % aqueous solution of epichlorohydrin-modified polymido-polyamine resin serving as a water-resistant agent.

The mixture was diluted with water to a solids concentration of 16 wt. % to obtain an overcoat composition, which was 6 in pH and 100 cps in viscosity at 25° C.

An overcoat layer chiefly comprising the composition was formed over the heat-sensitive color forming composition layer prepared in Reference Example 1 in the same manner as in Example 1 to obtain a heat-sensitive record paper. The paper was used for printing and tested in the same manner as in Example 1. Table 2 shows the results. Table 1 shows the ingredients and properties of the overcoat composition obtained.

TABLE 1

| Ex. No. | PVA Kind | PVA Amount (parts) | Monomer A Kind | Monomer A Amount (parts) | Monomer B Kind | Monomer B Amount (parts) | Monomer C Kind | Monomer C Amount (parts) | Monomer D Kind | Monomer D Amount (parts) | Solids content (%) | pH | Viscosity (cps) 25° C. |
|---|---|---|---|---|---|---|---|---|---|---|---|---|---|
| 1 | PVA110 | 40 | MMA | 40 | 2HEA | 35 | MAA | 25 | — | — | 20 | 6.0 | 300 |
| 2 | PVA210 | 40 | MMA | 40 | 2HEA | 35 | MAA | 25 | — | — | 20 | 6.0 | 400 |
| 3 | PVA110 | 20 | MMA | 40 | 2HEA | 35 | MAA | 25 | — | — | 20 | 6.0 | 450 |
| 4 | PVA110 | 40 | MMA | 60 | 2HEA | 25 | MAA | 15 | — | — | 20 | 6.0 | 200 |
| 5 | PVA110 | 40 | MMA | 25 | 2HEA | 45 | MAA | 30 | — | — | 20 | 6.0 | 600 |
| 6 | PVA110 | 40 | MMA | 30 | 2HEA | 45 | MAA | 25 | — | — | 20 | 6.0 | 500 |
| 7 | PVA110 | 40 | MMA | 50 | 2HEA | 20 | MAA | 30 | — | — | 20 | 6.0 | 250 |
| 8 | PVA110 | 40 | MMA | 50 | 2HEA | 40 | MAA | 10 | — | — | 20 | 6.0 | 350 |
| 9 | PVA110 | 40 | MMA | 35 | 2HEA | 30 | MAA | 25 | AN | 10 | 20 | 6.0 | 300 |
| 10 | PVA110 | 40 | MMA | 40 | 2HEA | 35 | MAA | 25 | — | — | 20 | 6.0 | 250 |
| 11 | PVA110 | 40 | MMA | 40 | 2HEA | 35 | MAA | 25 | — | — | 20 | 6.0 | 100 |

Note:
In the table, MMA stands for methyl methacrylate, 2 HEA for 2-hydroxyethyl acrylate, MAA for methacrylic acid, and AN for acrylonitrile.

TABLE 2

| Example No. | Color forming property: Density (dynamic) | Color forming property: Background area density | Resistance to: Water | Resistance to: Plasticizer | Resistance to: Oil | Resistance to Alcohol: Printed area | Resistance to Alcohol: Background area | Resistance to Vinegar: Printed area | Resistance to Vinegar: Background area | Sticking |
|---|---|---|---|---|---|---|---|---|---|---|
| 1 | 1.35 | 0.07 | A | A | A | 1.10 | 0.16 | 1.27 | 0.14 | ○ |
| 2 | 1.40 | 0.07 | A | A | A | 1.15 | 0.16 | 1.31 | 0.14 | ○ |
| 3 | 1.30 | 0.07 | A | A | A | 1.02 | 0.16 | 1.18 | 0.14 | ○ |
| 4 | 1.30 | 0.07 | A | A | A | 1.02 | 0.16 | 1.18 | 0.14 | ○ |
| 5 | 1.40 | 0.07 | A | A | A | 1.10 | 0.16 | 1.31 | 0.14 | ○ |
| 6 | 1.40 | 0.07 | A | A | A | 1.10 | 0.16 | 1.31 | 0.14 | ○ |
| 7 | 1.35 | 0.07 | A | A | A | 1.10 | 0.16 | 1.27 | 0.14 | ○ |
| 8 | 1.35 | 0.07 | A | A | A | 1.10 | 0.16 | 1.27 | 0.14 | ○ |
| 9 | 1.35 | 0.07 | A | A | A | 1.15 | 0.16 | 1.31 | 0.14 | ○ |
| 10 | 1.45 | 0.07 | A | A | A | 1.20 | 0.16 | 1.31 | 0.14 | ○ |
| 11 | 1.45 | 0.07 | A | A | A | 1.30 | 0.16 | 1.34 | 0.14 | ○ |
| Control | 1.25 | 0.07 | C | C | C | 0.90 | 0.30 | 0.90 | 0.35 | ○ |
| Comp. Ex. 1 | 1.20 | 0.10 | C | B | B | 0.90 | 0.20 | 0.93 | 0.23 | X |
| 2 | 1.15 | 0.08 | B | C | C | 0.95 | 0.25 | 0.90 | 0.30 | X |

COMPARATIVE EXAMPLE 1

An overcoat layer was formed in the same manner as in Example 1 over the heat-sensitive color forming layer prepared in Reference Example 1 using 7.5% aqueous solution of PVA 110 (6.5 in pH and 100 cps in viscosity at 25° C.) to obtain a heat-sensitive record paper. The paper was used for printing and tested in the same manner as in Example 1. Table 2 shows the results.

COMPARATIVE EXAMPLE 2

An overcoat layer was formed in the same manner as in Example 1 over the heat-sensitive color forming layer prepared in Reference Example 1 using an acrylic copolymer emulsion (5.5 in pH, 50 cps in viscosity at 25° C. and 25% in solids content) comprising 50 wt. % of methyl acrylate, 40 wt. % of 2-ethylhexyl acrylate and 10 wt. % of methacrylic acid, whereby a heat-sensitive record paper was obtained. The paper was used for printing and tested in the same manner as in Example 1. Table 2 shows the results.

We claim:

1. A heat-sensitive record material which comprises a substrate, a heat-sensitive layer bonded to the substrate and an overcoat layer of an overcoat composition coating the surface of the heat-sensitive layer, said overcoat composition comprising as an effective component thereof an emulsion of graft copolymer prepared by graft-copolymerizing methyl (meth)acrylate (A), a lower hydroxyalkyl (meth)acrylate (D) and (meth)acrylic acid (C) with a polyvinyl alcohol in the presence of water and a neutralization salt of diisobutylene-maleic anhydride copolymer.

2. A heat-sensitive record material as defined in claim 1, wherein the graft copolymer is a graft copolymer obtained by graft-copolymerizing the monomer (A), the monomer (B), the monomer (C) and a vinyl monomer (D) copolymerizable with the monomers (A), (B) and (C).

3. A heat-sensitive record material as defined in any one of claims 1–2, wherein the polyvinyl alcohol is used in an amount of 5–100 parts by weight per 100 parts by weight of the combined amount of the monomers.

4. A heat-sensitive record material as defined in any one of claims 1–2, wherein the neutralization salt of diisobutylene-maleic anhydride copolymer is used in an amount of 2.5-40 parts by weight per 100 parts by weight of the combined amount of the monomers.

5. A heat-sensitive record material as defined in claim 2, wherein the vinyl monomer (D) is copolymerized along with the monomers (A), (B), and (C) in an amount of up to 30 wt. % per 100 wt. % of the combined amount of all the monomers.

6. A heat-sensitive record material as defined in claim 1, wherein the graft copolymer is graft copolymer obtained by graft-copolymerizing 15–85 wt. % of the monomer (A), 15–75 wt. % of the monomer (B) and 5–45 wt. % of the monomer (C) per 100 wt. % of the combined amount of the monomers.

7. A process for preparing a heat-sensitive record material comprising coating the surface of the heat-sensitive layer bonded to a substrate of a heat-sensitive record material with an overcoat composition comprising as an effective component thereof an emulsion of graft copolymer prepared by graft-copolymerizing methyl (meth)acrylate (A), a lower hydroxyalkyl (meth)acrylate (B) and (meth)acrylic acid (C) with a polyvinyl alcohol in the presence of water and a neutralization salt of diisobutylene-maleic anhydride copolymer.

* * * * *